US006417756B1

(12) United States Patent
Yu

(10) Patent No.: US 6,417,756 B1
(45) Date of Patent: Jul. 9, 2002

(54) PUSH-BUTTON SWITCH WITH OVERLOAD PROTECTION AND AUTOMATIC RESET

(76) Inventor: Tsung-Mou Yu, No. 4, Alley 2, Lane 23, Sec. 3, Pa-Te Road, Pan-Chiao City, Taipei Hsien (TW)

( * ) Notice: Subject to any disclaimer, the term of this patent is extended or adjusted under 35 U.S.C. 154(b) by 0 days.

(21) Appl. No.: 09/602,480

(22) Filed: Jun. 23, 2000

(30) Foreign Application Priority Data

Jun. 24, 1999 (TW) ..... 88210456 U

(51) Int. Cl.[7] ..... H01H 71/16

(52) U.S. Cl. ..... 337/66; 200/520; 337/36; 337/56

(58) Field of Search ..... 337/3, 13, 36–38, 337/41, 53, 56, 62, 63, 66, 68, 72, 76, 85, 86, 91, 111, 333, 348, 357–359; 200/520–540, 310–316

(56) References Cited

U.S. PATENT DOCUMENTS 4,661,667 A 4/1987 Sorimachi et al. ..... 200/314
4,704,594 A 11/1987 Krasser ..... 337/66
4,931,762 A 6/1990 Fierro ..... 337/66
4,937,548 A 6/1990 Sdunek ..... 337/70
5,223,813 A 6/1993 Cambreleng et al. ..... 337/66
5,451,729 A 9/1995 Onderka et al. ..... 200/18
5,786,742 A 7/1998 Yin ..... 337/66
6,249,209 B1 * 6/2001 Yu ..... 337/37

* cited by examiner

*Primary Examiner*—J. R. Scott

(57) ABSTRACT

A push-button switch with overload protection and automatic reset is disclosed. The switch comprises a housing, a conducting unit, and an actuating unit. The conducting unit comprises several terminals, a normal-opened first conducting leaf and a thermally deformed bimetal sheet. The bimetal sheet is of a U shape having a working end and an opening end. The working end can deform to an overload position from a normal position in response to overload occurred in the conducting unit. The actuating unit comprises a stem, a locating cantilever, a rocking lever, an enabling rest, a cantilever pusher, and a lever reseating member. By means of the above structure, even though the stem is jammed, a trip action is still exactly performed in case of overload. Moreover, the switch of this invention will automatically reset when overload occurs by virtue of the cantilever pusher.

8 Claims, 11 Drawing Sheets

PUSH-BUTTON SWITCH WITH OVERLOAD PROTECTION AND AUTOMATIC RESET

BACKGROUND OF THE INVENTION

The present invention relates to a push-button switch and, in particular, to a push-button switch having a simple structure for overload protection and automatic reset.

There are many types of push-button switches for various applications, such as one having a turn-on indicating lamp and one provided with an overload protection function. In terms of one having an overload protection function, there are also several kinds of protection principles or mechanisms being adopted. For example, both the blow-out of a fuse wire and the tonal deformation of a bimetal blade have ever been adopted as a trigger source for an overload protection. However, the fuse wire is not repetitive and thus its utility rate gradually decreases. As for the thermal bimetal blade, there are many kinds of mechanism, such as is those disclosed in U.S. Pat. Nos. 5,786,742, 5,223,813, 4,937,548, 4,661,667, 4,931,762, 5,451,729, and 4,704,594.

For example, in the U.S. Pat. No. 5,786,742, a so-called power-cutting member (72) used to alternatively set a set and a reset positions of a switch is disclosed. In that case, a bimetallic blade (75) is used to push a shaft seat (71) to trip and automatically reset a switch. However, the contacts in such a switch are directly depressed by a button. Thus, if the button has jammed or pushed down by an external force, they would be kept in its conducting position even if overload occurs. Moreover, such a switch is not economical because of a use of up to four contacts to construct a conducting circuit. The possibility of generating an arc also increases. Furthermore, such a switch is troublesome to provide a wire connecting the bimetallic blade (75) with the conducting plate (74).

In U.S. Pat. No. 5,223,813, a bimetal beam (13), a common trip (17) actuated by the bimetal beam, and a cam member (27) are incorporated with a rocker actuator (33) to perform a contact between contact members (7,1). In such a switch, the common trip (17) will result in a displacement in response to the deformation of the bimetal beam so as to release the cam member and to trip the switch. Since the common trip is indirectly actuated by a rocker actuator, a jamming of the rocker actuator and a neglectful re-push on the switch after overload can be avoided. However, such a switch is rather complicated. Moreover, since it needs a wire to be connected between its cantilever spring (5) and its bimetal beam (13), its assembly is also troublesome. Furthermore, a fail-action could possibly happen when overload occurs since the bimetal beam may be not able to simultaneously actuate the rocker actuator (33) and the common trip (17).

In U.S. Pat. No. 4,937,548, a circuit breaker which utilizes the deformation of a thermal actuator (76) to displace a lock lever (62) so as to release a bell crank lever operator (52) is disclosed. In this case, a movable contact (86) is indirectly actuated by the actuator, and thus a jamming of the actuator and a re-push on the switch in case of overload can be avoided. However, such an arrangement is not provided with an automatic resetting function, and an indicating lamp is difficult to install therein. In U.S. Pat. No. 4,661,667, a double-heart-shaped cam locking mechanism is used to obtain two locking-positions. However, such a switch lacks an overload protection function as well as a status-indicating function.

SUMMARY OF THE INVENTION

A main object of the present invention is to provide a push-button switch having a simple structure easy to assemble and having a low manufacturing cost.

Another object of this invention is to provide a push-button switch having an overload protection mechanism capable of exactly and transiently operating at a critical point of overload.

Yet another object of this invention is to provide a push-button switch having an automatic resetting mechanism for simultaneously resetting the switch in case of overload.

To achieve the above objects of this invention, this invention provides a push-button switch with overload protection and automatic reset, comprising:

a housing;

a conducting unit installed in the housing and including a first terminal, a second terminal, a first conducting leaf, and a flat bimetal sheet; the bimetal sheet having a movable working end, being able to move to an overload position from a normal position in case of overload, and a fixed opening end formed with first and second legs for respectively connecting with the first terminal and the first conducting leaf; the first conducting leaf being movable between a closed position in which the second leg of the bimetal sheet is electrically connected to the second terminal and a normal-open position in which the second leg is disconnected from the second terminal;

an acting unit installed in the housing and including:

a stem provided with a heart-shaped stepping recess and being able to slidably move between an upper reset position and a lower set position;

a locating cantilever provided with a first hand pivotally mounted at the housing and a second hand movably inserted into the heart-shaped stepping recess for locating the position of the stem;

a rocking lever pivotally supported on the stem along a shaft and formed with a nose for depressing the first conducting leaf and with a resting tail opposite to the nose across the shaft;

an enabling rest capable of moving between a supporting position to support the resting tail and a withdrawing position to withdraw from the resting tail, in correspondence with the location of the bimetal sheet in the normal position and the overload position, respectively;

a cantilever pusher for pushing the locating cantilever away from the heart-shaped stepping recess in response to the change of the bimetal sheet into its overload position; and a lever reseating member for pushing the rocking lever into an idle position in which the resting tail could be supported by the enabling rest during a reset course in which the stem moves from the set position to the reset position;

whereby the nose can depress and release the first conducting leaf so as to make the first conducting leaf move into the closed position and the normal-open position in response to the movement of the stem to its set position and its reset position, respectively, in a situation that the enabling rest locates in its supporting position, and whereby the first conducting leaf and the stem can move to its normal-open position and its reset position, respectively, in response to a change of the bimetal sheet into its overload position.

By means of the above structure, even if the stem jams, the switch can still exactly and transiently trip at the time overload occurs. Moreover, by virtue of the cantilever pusher, the switch could be automatically reset after overload occurs and thus make the procedure to operate the switch simple.

In a preferred embodiment, the working end of the bimetal sheet deflects away from the resting tail upon overload and has a side edge and an end edge, and the enabling rest is integrally formed with the bimetal sheet on the side edge and formed with a platform on which the resting tail can rest.

By means of the special structure of the bimetal sheet, a protection mechanism having a simpler structure with more elasticity is available and thus its assembly becomes easier.

BRIEF DESCRIPTION OF THE DRAWINGS

In the following, preferred embodiments of the present invention will be described in detail in conjunction with the accompanying drawings, wherein.

DETAILED DESCRIPTION OF THE INVENTION

Figure 1:
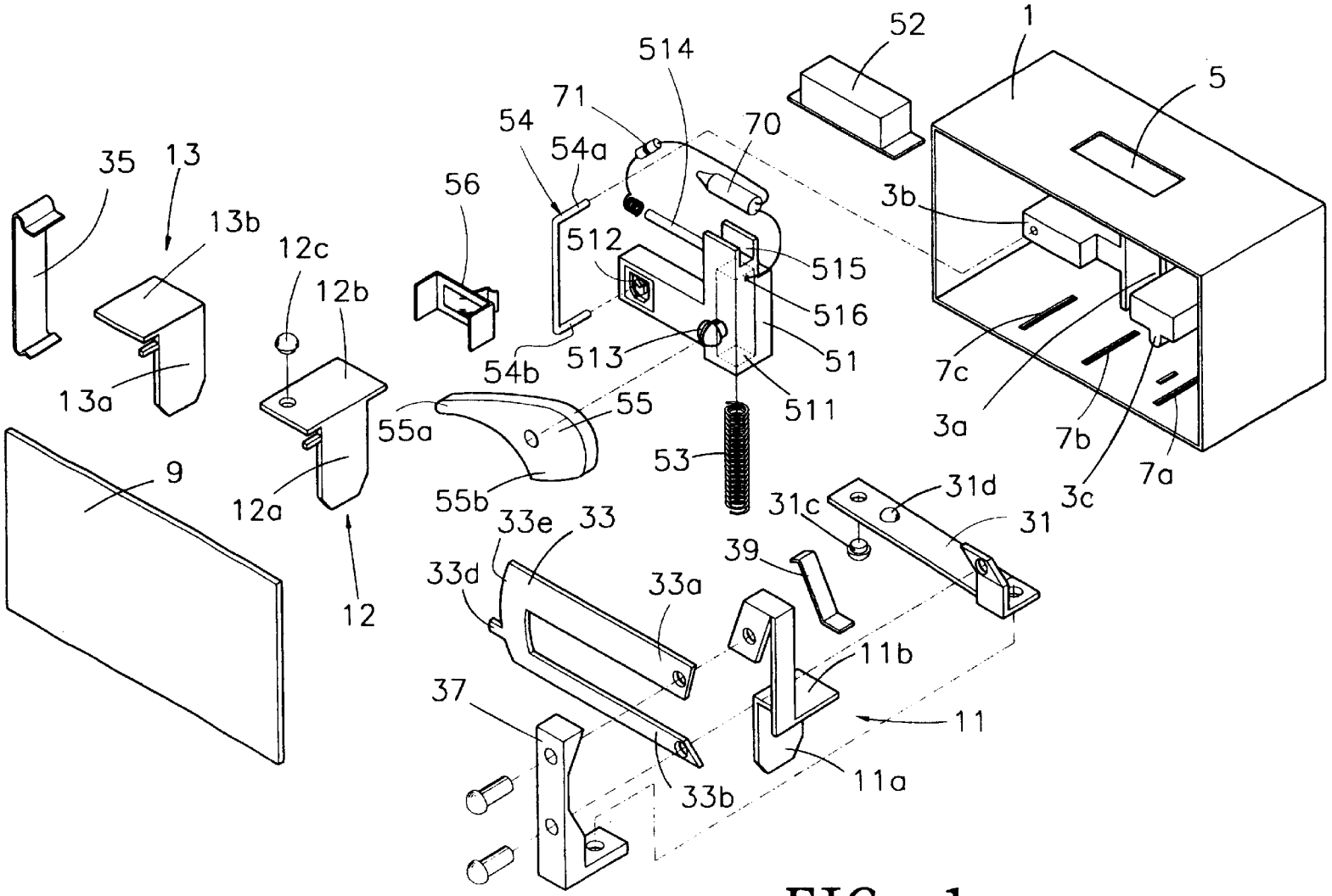
FIG. 1 is a perspective exploded schematic view of a push-button switch with overload protection and automatic reset in accordance with a first embodiment of this invention.

As shown in FIG. 1, being a perspective exploded schematic view, the push-button switch with overload protection and automatic reset in accordance with a first embodiment of this invention generally comprises a conducting unit, an actuating unit, and a housing to hold all the elements.

The housing consists of a cover 9 and a shell 1. The shell 1 consists of five walls and is provided with an integrally-formed stem guide 3*a,* a button hole 5 formed in a top wall thereof, three terminal holes 7*a,*7*b,*7*c* formed in a bottom wall thereon a cantilever holder 3*b* and a lever reseating pin 3*c* (shown in FIG. 2) integrally formed therein.

The conducting unit comprises a first terminal 11, a second terminal 12, a third terminal 13, a first conducting leaf 31, a flat thermal-deflecting bimetal sheet 33, a second conducting leaf 35, a lamp 70, and a resistor 71. Each of the terminals 11,12,13 consists of an inserting portion 11*a,* 12*a,* 13*a* to be received in one of the terminal holes 7*a,* 7*b,* 7*c* and a tab portion 11*b,* 12*b,* 13*b* for connecting with the other conducting elements to construct a circuit loop. The first and third terminals 11, 13 are usually used to connect with an external power source. A static lower contact pad 12*c* is secured in a hole formed on the tab portion 12*b* of the second terminal 12 for contacting a movable upper contact pad 31*c* mentioned below.

The bimetal sheet 33 is of a reversed-U shape having two legs 33*a,* 33*b* and a working end 33*e.* The two legs 33*a* 33*b* are fixed while the working end 33*e* is movable. The two legs 33*a,* 33*b* are fixed by an insulating carrier 37 such that the surface of each leg is slanted to each other at a certain angle. The leg 33*a* electrically connects with the first terminal 11.

Figure 4:
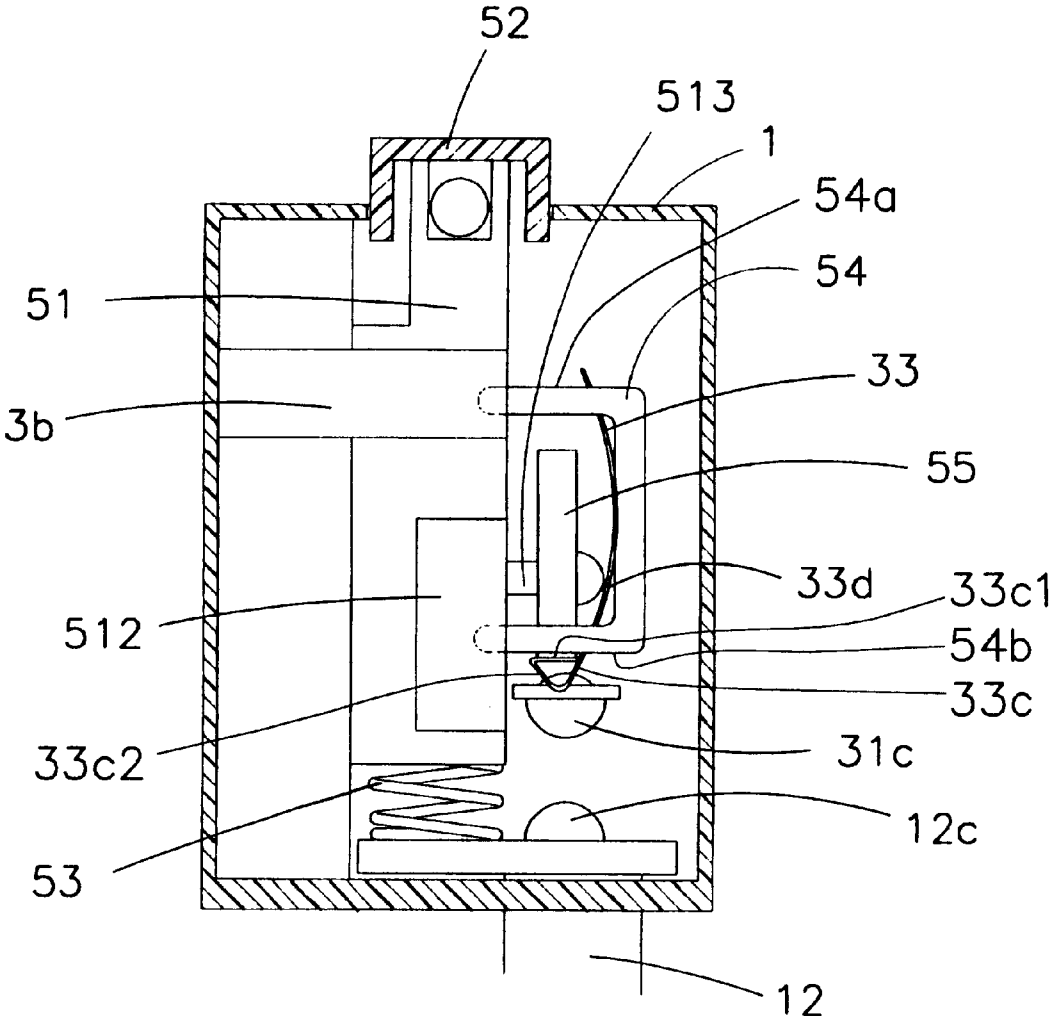
FIG. 4 is a side view partly in section taken along a line IV—IV of FIG. 2.
Figure 5:
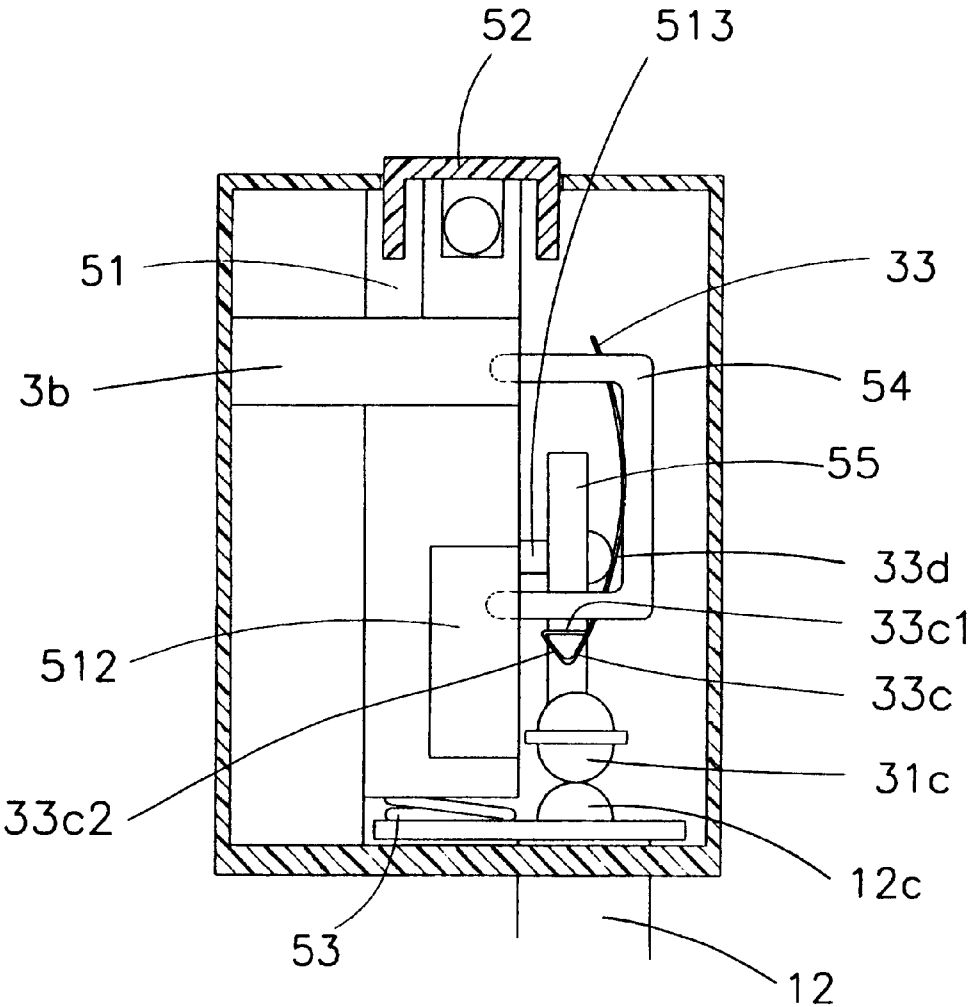
FIG. 5 is a side view partly in section taken along a line V—V of FIG. 3.
Figure 6:
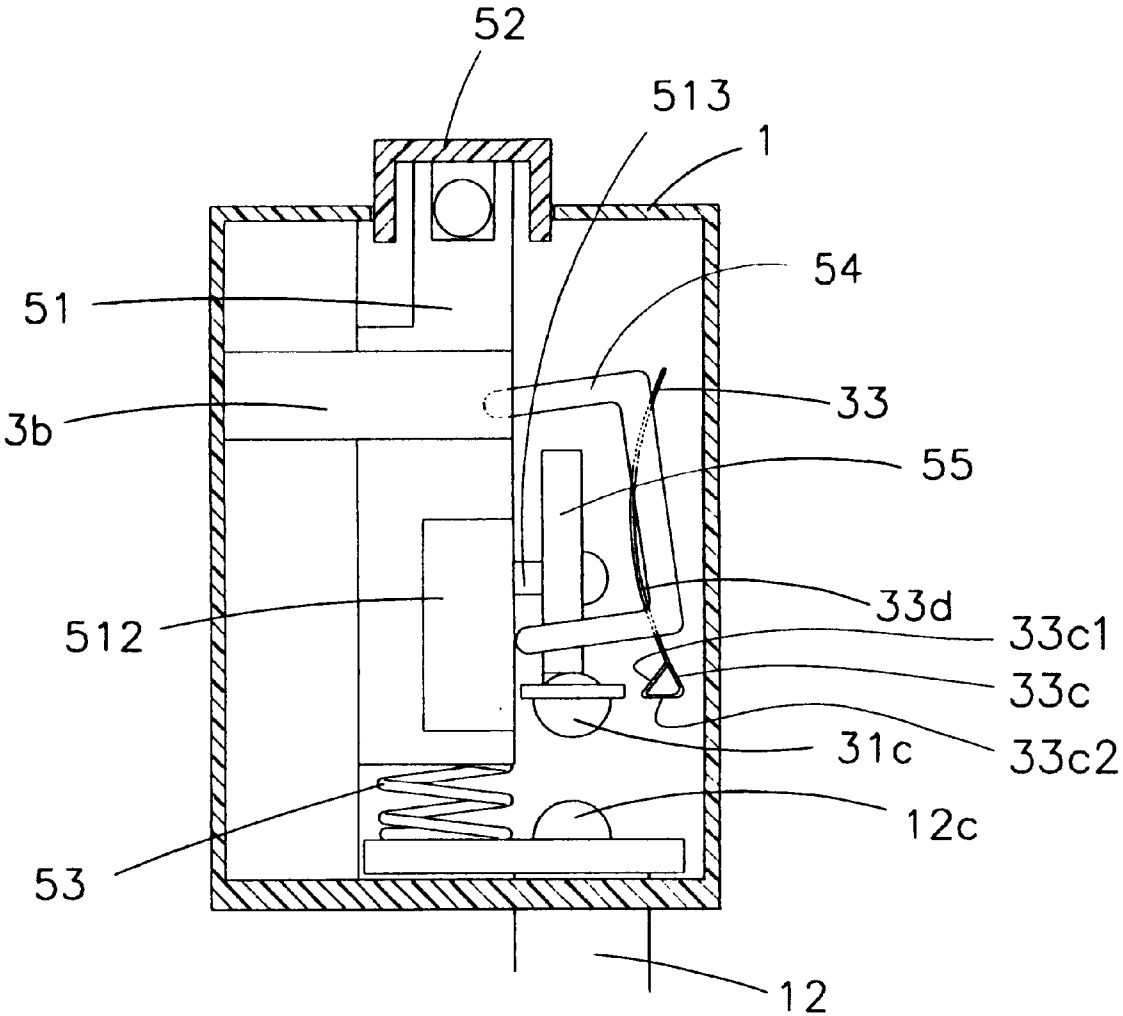
FIG. 6 is a side view similar to FIG. 5 except in a trip status.

The two legs 33*a,* 33*b* stand at an angle to each other. By means of such an arrangement, the working end 33*e* of the bimetal sheet 33 will snap to a forward-curved overload position as shown in FIG. 6 from a backward-curved normal position as shown in FIG. 4 in case the current flowing therethrough is beyond an overload critical point.

As an alternative modification, the insulating carrier 37 many be omitted as long as the two legs can be fixed. Moreover, the surfaces of the two legs also can be co-planar. In such a case, the working end of the bimetal sheet can also deflect when overload occurs but deflects slowly.

Moreover, the bimetal sheet 33 is provided with an enabling rest 33*c* extending from the bottom side edge 33*e*1 of the working end and a cantilever pusher 33*d* extending from the lower left end edge 33*e*2 thereof. The enabling rest 33*c* is defined herein as a member of the actuating unit and bend to include a platform 33*c*1 and an oblique lower surface 33*c*2. The cantilever pusher 33*d* is also defined herein as a member of the actuating unit and extends across a locating cantilever 54 mentioned below.

The first conducting leaf 31 is made of a flat metallic plate and has a fixed end and a free end, the fixed end being electrically connected to the leg 33*b* of the bimetal sheet 33. The free end of the fast conducting leaf 31 is attached with an upper contact pad 31*c* and is capable of moving between a closed/conducting position in which the upper contact pad 31*c* contacts the lower static contact pad 12*c* and an open/braking position in which the two contact pads 31*c* and 12*c* separate from each other. The free end of the first conducting leaf 31 is biased toward the open position by a return spring 39 inserted into the shell 1 at one end thereof. The middle portion of the first conducting leaf 31 is formed with a dome 31*d* on its upper surface for bearing an action from the acting unit. However, the dome 31*d* and the return spring 39 are omissible.

The second conducting leaf 35 is used to connect the third terminal 13 to the lamp 70. One end of the second conducting leaf 35 is fixed by and in conduction with the tab portion 13*b* of the third terminal 13. The other end of the second conducting leaf 35 extends upward along the side wall of the shell 1 and fixed by a post 19 protruding from the top wall of the shell 1.

The actuating unit comprises a stem 51 capable of vertically moving in the shell 1, a button 52 mounted on the top of the stem 51, a coil spring 53 for biasing the stem 51 upward, a locating cantilever 54 for limiting the position of the stem 51, and a rocking lever 55 pivotally supported by the stem 51 for depressing the first conducting leaf 31.

The stem 51 is provided with a body portion 511, a heart-shaped stepping recess 512 integrally formed one a side surface of the body portion 511, a snap shaft 513 integrally formed on a front surface of the body portion 511, a branch 514 integrally extending from an upper side surface of the body portion 511, and a slot 515 formed on a top surface of the body portion 511 for receiving the lamp 70.

The body portion 511 is guided by the guide 3*a* and is formed with an internal cavity (no numeral indicated) opening downward for receiving the coil spring 53, and a hole 516 in one side wall thereof for the entrance of one leg of the lamp 70 into the cavity from the outside thereof. The heart-shaped stepping recess 512 is of a structure like the power-cutting member 72 disclosed in the U.S. Pat. No. 5,786,742. The disclosure in such a patent is incorporated herein by reference and thus its detailed description is omitted herein. The snap shaft 513 is provided for supporting the rocking lever 55 along a pivoting axis. The branch 514 is used to carry one leg of the resistor 71 into contact with the second conducting leaf 35 when the stem 51 is moved to its set position.

Figure 2:
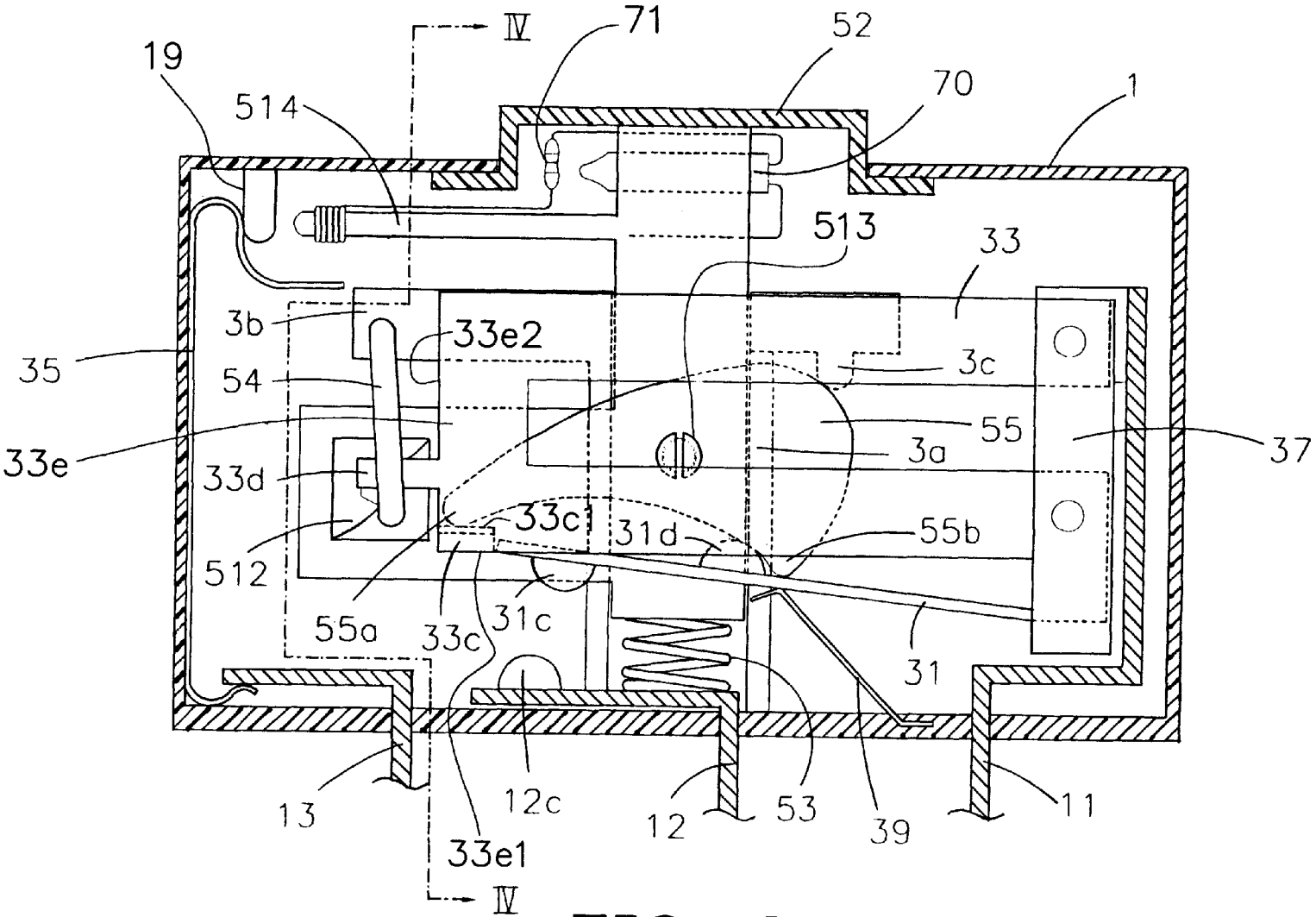
FIG. 2 is an assembled elevation view partly in section of the push-button switch of FIG. 1 in an OFF status.

The button 52 is provided with a cavity facing downward to cover the lamp 70 and the slot 515. The top wall of the button 52 is preferably transparent. The coil spring 53 is conductive and is arranged such that its upper end contacts the leg of the lamp 70 while its lower end contacts the tab portion 12*b* of the second terminal 12, as shown in FIG. 2.

The locating cantilever 54 is of a U shape and has an upper hand 54*a* and a lower hand 54*b*. The upper hand 54*a* of the locating cantilever 54 is pivotally inserted into a hole formed in the holder 3*b* while the lower hand 54*b* is slidably inserted into the heart-shaped stepping recess 512. The lower hand 54*b* of the locating cantilever 54 will be kept in the recess 512 by a biasing spring 56.

The rocking lever 55 is formed with a forcing hole (no numeral indicated) as well as a resting tail 55*a* and a nose 55*b* respectively located on two sides of the forcing hole. The forcing hole of the rocking lever 55 can be penetrated by the snap shaft 513 so that the rocking lever 55 can pivot around and be forced by the snap shaft 513. The nose 55*b* functions to depress the dome 31*d* provided on the first conducting leaf 31 if the stem 51 is pushed downward to its set position. The resting tail 55*a* functions as a supporting point for the rocking lever 55 when it is supported by the enabling rest 33*c*.

In the following, the operation of the switch having the above structure will be described. Firstly, the switch shown in FIG. 2 is considered, it being of a normal OFF status when all the elements are assembled into the shell 1. As shown in FIG. 2, the stem 51 is in an ascendant reset position; the upper contact pad 31*c* separates from the lower contact pad 12*c* and thus the first conducting leaf 31 is in an open position; the upper end of the second conducting leaf 35 separates from a leg of the resistor 71 and thus the lamp 70 cannot emit light; the lower hand of the locating cantilever 54 is located at a lower end of the heart-shaped stepping recess 512; and the resting tail 55*a* of the rocking lever 55 is supported by the enabling rest 33*c* and thus the rocking lever 55 is in an enabled and idle position.

Figure 3:
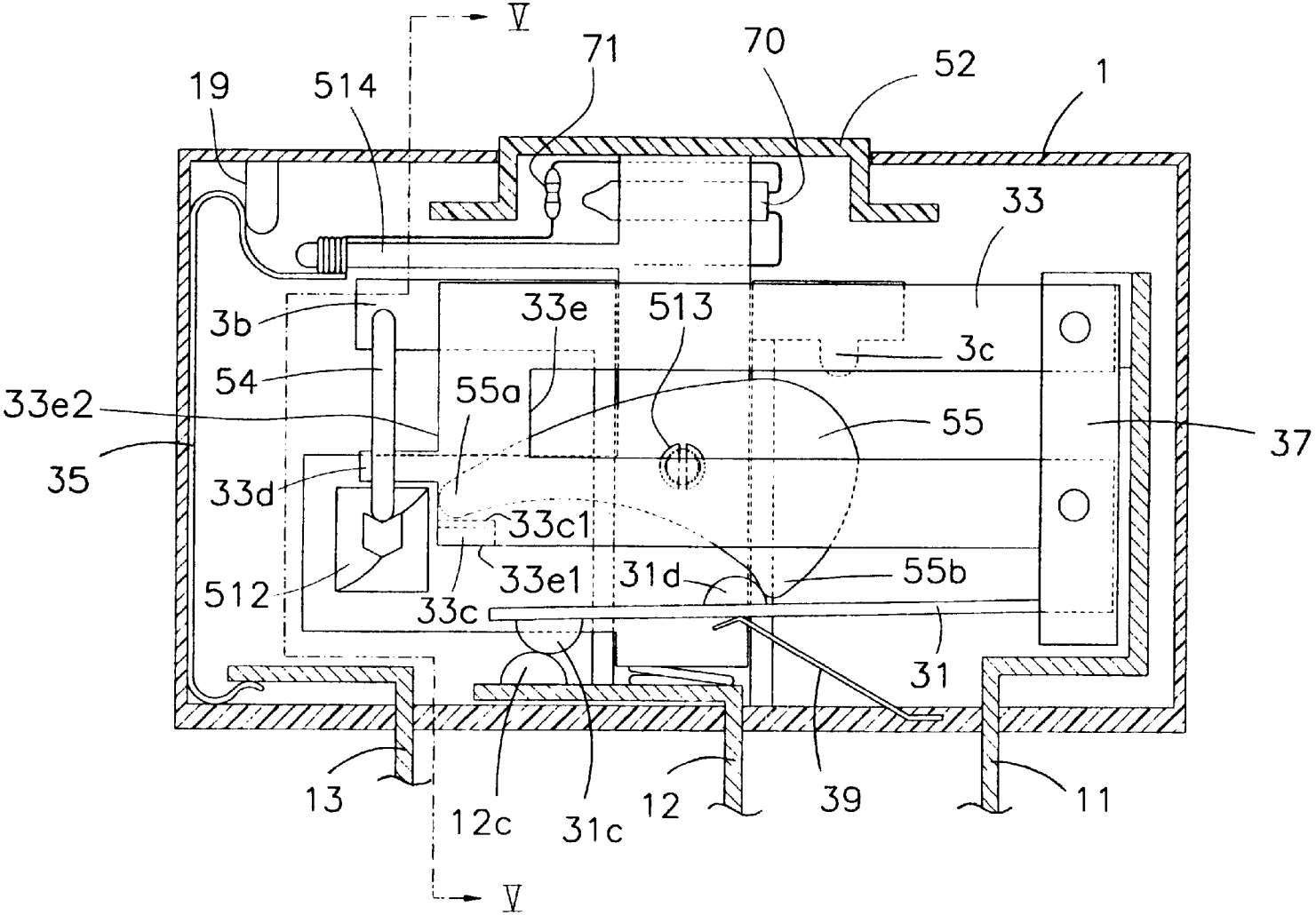
FIG. 3 is a view similar to FIG. 2 except in an ON status.

In case the button 52 is depressed downward so as to switch the switch into an ON status, as shown in FIG. 3, the stem 51 will move downward and the lower hand of the cantilever 54 will simultaneously slide into an upper notch of the heart-shaped stepping recess 512 and thus limit the stem 51 in its set position. In the meanwhile, the nose 55*b* moves downward to depress the dome 31*d* of the first conducting leaf 31, by virtue of fact that the resting tail 55*a* is sustained by the enabling rest 33*c* and that the forcing hole of the rocking lever 55 is carried downward by the snap shaft 513, Thus, the rocking lever 55 is in an enabled and acting position, in which the upper contact pad 31*c* provided on the first conducting leaf 31 contacts the lower contact pad 12*c* provided on the second terminal 12 so that an ON status is built. On the other hand, the upper end of the second conducting leaf 35 will contact one leg of the resistor 71 in line with the descent of the stem 51, and thus form a conduct between the second and the third terminals 12, 13 via the second conducting leaf 35, the resistor 71, the lamp 70, and the coil spring 53.

During the ON status, in case the current flowing through the switch is overload, as shown in FIG. 6, the bimetal sheet 33 will snap into a frontward-curved overload position, which concurrently takes the enabling rest 33*c* away from the resting tail 55*a* of the rocking lever 55 into a withdrawing position and makes the cantilever pusher 33*d* push the lower hand of the locating cantilever 54 away from the upper notch of the heart-shaped stepping recess 512. In such a situation, the resting tail 55*a* of the rocking lever 55 will momentarily descend and the nose 55*b* releases the first conducting leaf 31. At the same time, the stem 51 moves upward by virtue of the spring 53 in response to the release of the locating cantilever 54 from the heat-shaped stepping recess 512. The rocking lever 55 is thus moved upward by the stem 51 and into its idle position, by is virtue of the reaction of the lever reseating pin 3*c* with an upper edge of the rocking lever 55 opposite the nose 55*b,* but not enabled until the bimetal sheet 33 return to its normal position. Thus, The first conducting leaf 31 changes into an open position and the lamp 70 is turned off. The switch is therefore in a trip status in which the stem 51 is reset. Once the bimetal sheet 33 returns to its normal position, the enabling rest 33*c* will return to its supporting position and thus make the rocking lever 55 enabled while the lower hand of the locating cantilever 54 falls into the recess 512 and thus the stem 51 can be set once more.

According to the above structure, in a trip status, the actuating unit will automatically return to its reset position as shown in FIG. 2. Even though the stem 51 is resisted ascending during reset the resting tail 55*a* still descends and makes the conductive leaf 31 be in an open position. Moreover, if the switch is to be turned-on after tripping in case the bimetal sheet does not return to its normal position, the conductive leaf 31 cannot get into its closed position and the stem 51 cannot be set in its set position. This is because the lower hand of the cantilever 54 is pushed away from the heart-shaped stepping recess 512, the resting tail 55*a* is not supported by the enabling rest 33*c,* and thus the nose 55*b* cannot depress the conductive leaf 31 onto the second terminal 12.

On the other hand, if the switch is to be turned-off during the ON status in which no overload happens, depressing the stem 51 could make the switch return to its OFF status. That is, in line with depressing the stem 51, the lower hand of the cantilever 54 will escape from the upper notch of the heart-shaped stepping recess 512 and thus the stem 51 can ascend to its reset position under the action of the coil spring 53. The depression of the nose 55*b* on the first conducting leaf 31 is released and thus the first conducting leaf 31 is in an open position while the leg of the resistor 71 along with the branch 514 separate from the second conducting leaf 35. Thus, the switch is reset to an OFF status as shown in FIG. 2.

By means of the above structure, the switch of this invention can obtain an exact overload protection and an automatic reset with a simple, low-cost, and easily assembled structure. However, it should be understood that the omission of the third terminal 13, the second conducting leaf 35, the resistor 71, and the lamp 70 would not affect the practice and the concept of this invention.

Figure 7:
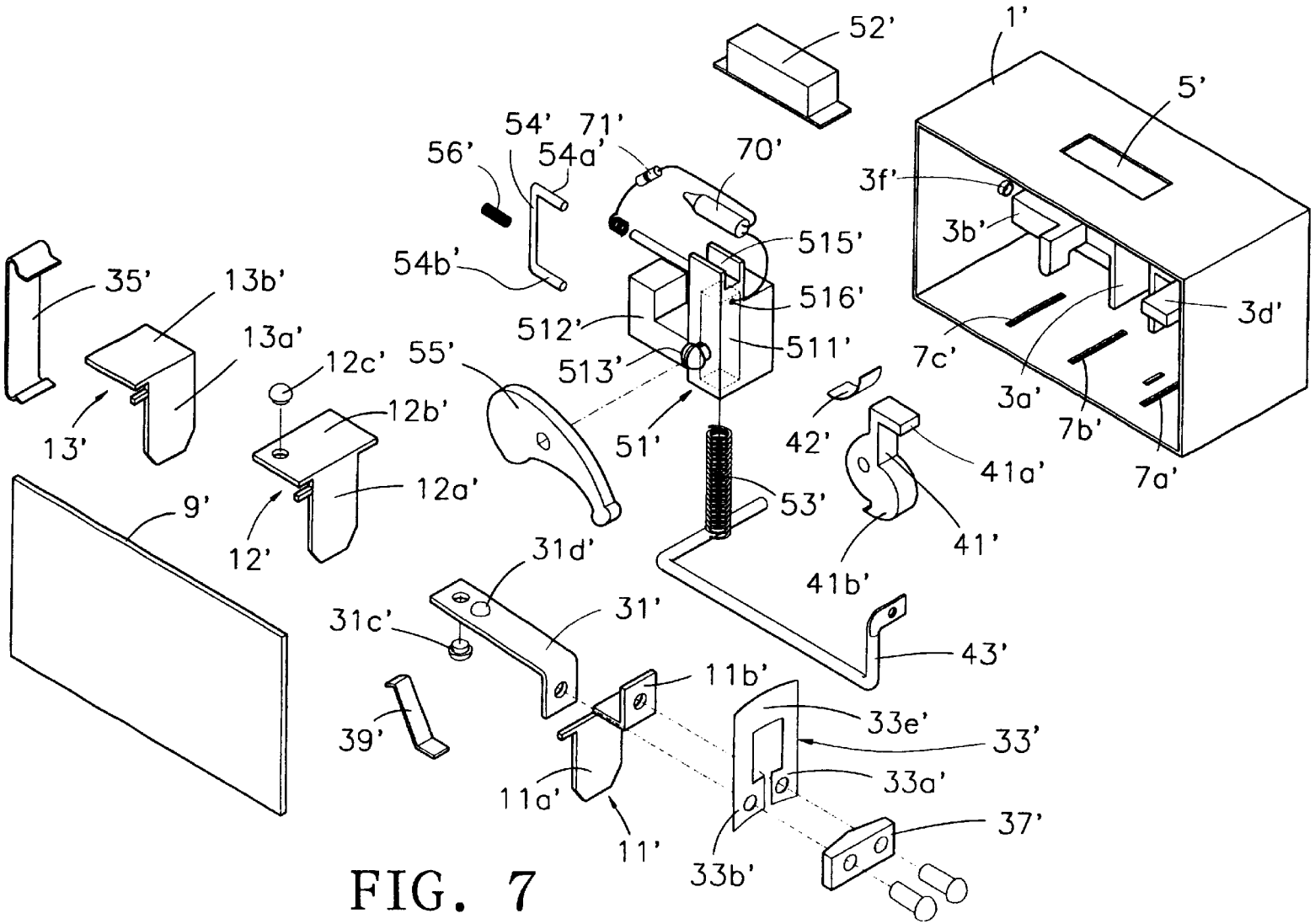
FIG. 7 is a perspective exploded schematic view of a push-button switch with overload protection and automatic reset in accordance with a second embodiment of this invention.

FIGS. 7 shows a push-button switch with overload protection and automatic reset in accordance with a second embodiment of this invention. For the benefit of recognition, the parts corresponding to those in the first embodiment are indicated with the same numerals respectively and all indicated numerals are attached with a prime symbol.

Figure 8:
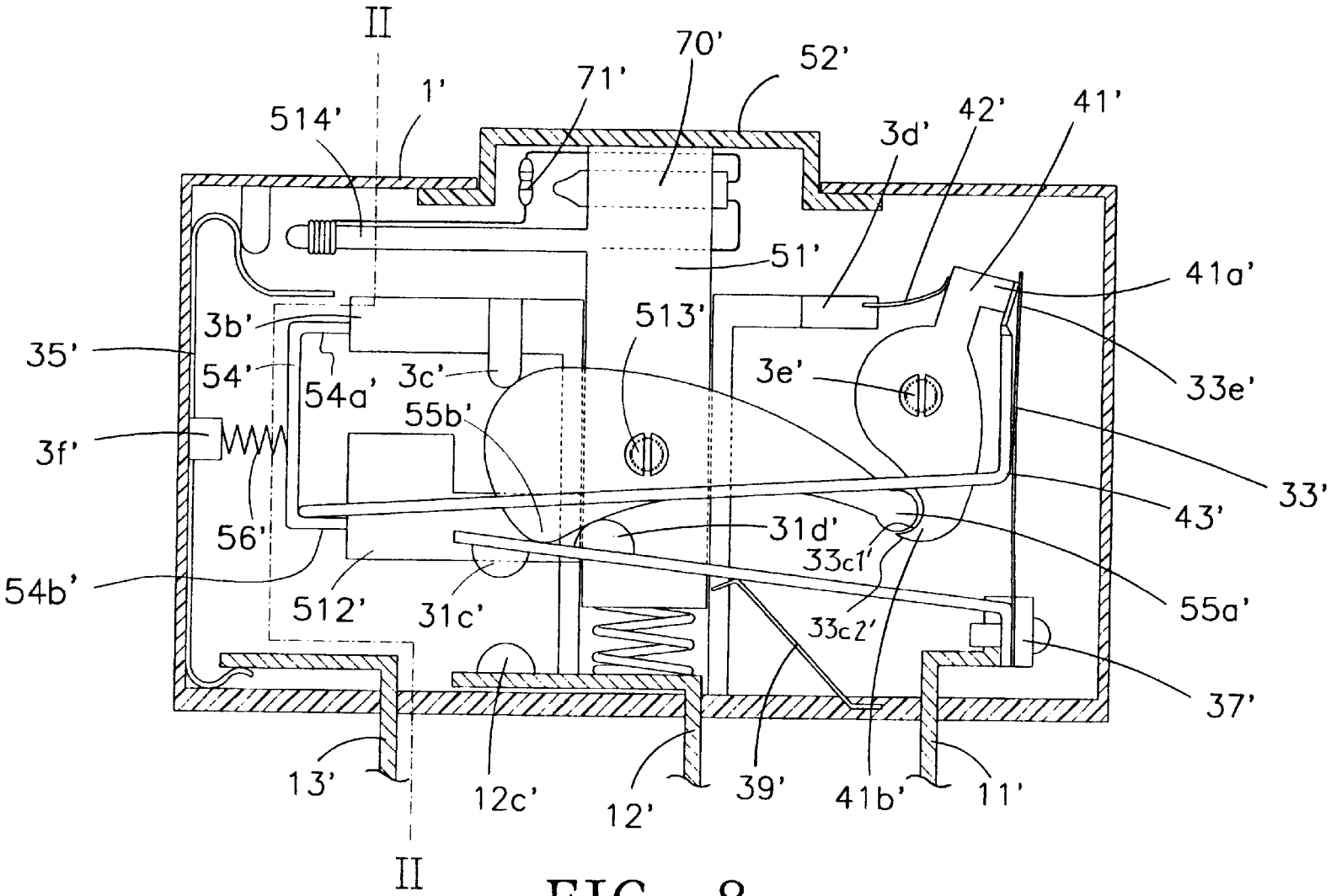
FIG. 8 is an assembled elevation view partly in section of the push-button switch of FIG. 7 in an OFF status.

As shown in FIGS. 7 and 8 concerning the second embodiment, the bimetal sheet 33 vertically extends from the right side of the shell 1' and is not integrally formed with the enabling rest and the cantilever pusher shown in the first embodiment. An enabling rest 41*b*' in this embodiment is formed at one end of an enabling lever 41' instead of in the bimetal sheet 33 in the first embodiment. A cantilever pusher 33*d* in the first embodiment is replaced with a crank rod 43' in this embodiment. A heart-shaped stepping recess 512' in this embodiment opens toward the left sidewall of the shell 1', and the location of the resting tail 55*a*' of the rocking lever 55' is changed to the right side with respect to the forcing hole thereof. Moreover, the two legs of the bimetal sheet 33' are relatively bent toward the right sidewall in its normal status. The other parts are substantially the same as those in the first embodiment and thus their descriptions are omitted herein.

The enabling lever 41' is pivotably mounted on the shell 1' and biased toward an enabling position as shown in FIG. 8 by a biasing leaf spring 42'. The enabling lever 41' is provided with a force-reception surface 41*a*' and the enabling rest 41*b*' at its two ends, respectively. The force-reception surface 41*a*' is provided to be pushed by the working end 33*e*' of the bimetal sheet 33' while the enabling rest 41*b*' is provided for supporting the resting tail 55*a*' of the rocking lever 55'. The enabling rest 41*b*' is also formed with a platform 33*e*1' to support the resting tail 55*a*' and an oblique lower surface 33*e*2' for the sliding pass of the resting tail 55*a'*.

The crank rod 43' acts as a cantilever pusher and has one hand secured on the force-reception surface 41*a*' and the other hand extending in a direction perpendicular to the extending direction of the locating cantilever 54' and disposed between the locating cantilever 54' and the heart-shaped stepping recess 512'. The position of the crank rod 43' between the two hands properly bends so as to prevent interference with the other elements.

FIG. 8 shows a sectional elevation view of the switch according to the second embodiment in an OFF status, in which an actuating unit is in a reset position, the bimetal sheet 33' is in a normal position, the enabling lever 41' is in a supporting position, the resting tail 55*a*' rests against the enabling rest 41*b*', the other hand of the crank rod 43' slightly contacts the locating cantilever 54', the contact pads 31*c*' and 12*c*' separate to each other, and one leg of the resistor 71' separates from the second conducting leaf 35'.

Figure 9:
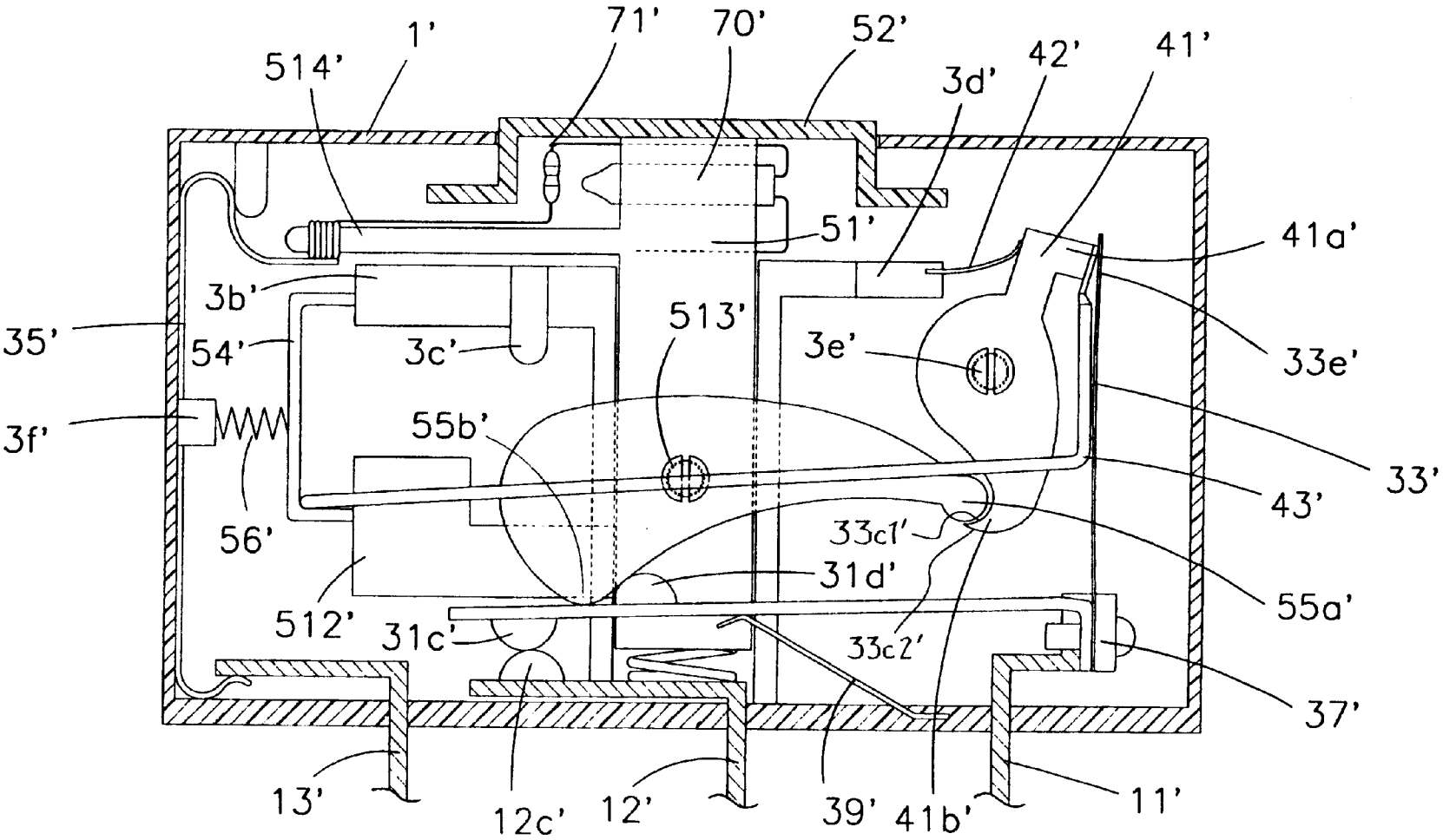
FIG. 9 is a view similar to FIG. 8 except in an ON status.
Figure 11:
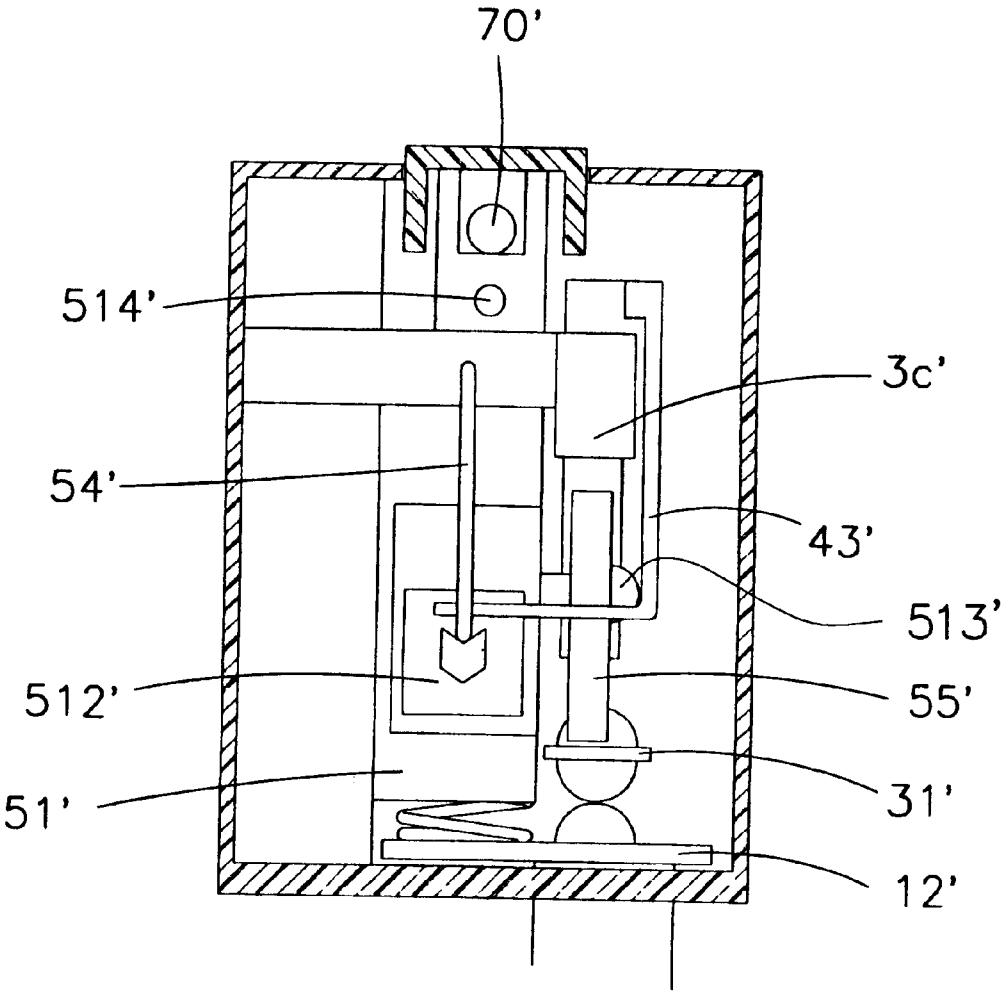
FIG. 11 is a side view partly in section taken along a line II—II of FIG. 8.

As shown in FIGS. 9 and 11, in case the switch is pressed into an ON status, the stem 51' is shifted to a descendent set position, the nose 55*b*' of the rocking lever 55' depresses the first conducting leaf 31, the contact pads 31*c*' and 12*c*' contact together, and one leg of the resistor 71' conducts the second conducting leaf 35'. However, the enabling lever 41' remains in its supporting position and the enabling rest 41*b*' thereof still supports the resting tail 55*a*'. The locating cantilever 54' is not pushed by the crankrod 43'.

Figure 10:
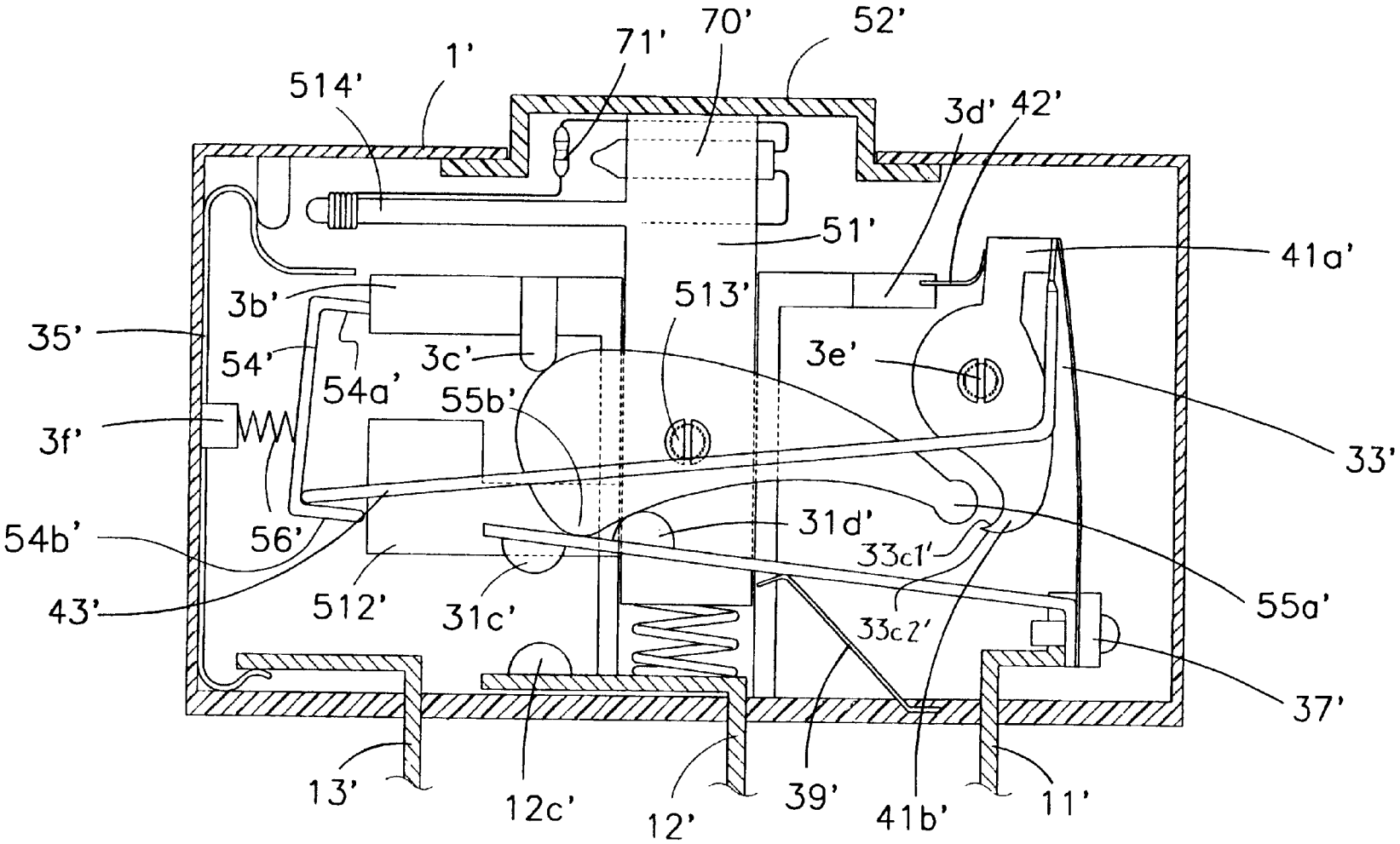
FIG. 10 is a view similar to FIG. 8 except in a trip status.

Like the operation in the first embodiment, the working end 33*e*' of the bimetal sheet 33' will shift toward the left side if the current flowing through the switch overloads. The enabling lever 41' is thereby rotated counterclockwise and the crank rod 43' is shifted toward the left side. Thus, the enabling rest 41*b*' will escape from the resting tail 55*a*' and the lower hand 54*b*' of the locating cantilever 54' is moved away from the heart-shaped stepping recess 512'. Continuously, as shown in FIG. 10, the depression of the nose 55*b*' on the first conducting leaf 31' is released, the two contact pads 31*c*', 12*c*' separate to each other, and the stem 51' is released to its ascendant reset position. In the meanwhile, the rocking lever 55' is rotated back to its idle position by the engagement of the rear edge of the rocking lever 55' opposite to the nose 55*b*' with the lever reseating pin 3*c*', and thus the switch automatically resets after overload.

Like the advantage in the first embodiment, even though the stem 51' resists ascending during resetting, a trip action is still exactly performed by the enabling lever 41' and the rocking lever 55', and thus an overload protection is assured.

While the present invention is described by way of preferred embodiments, it should be understood that the embodiment are used only to illustrate the technical concept of the present invention without limiting the scope thereof. It is therefore intended that all modifications and alterations that are readily apparent to those skilled in the art are within the scope as defined in the appended claims.

What is claimed is:

1. A push-button switch with overload protection and automatic reset, comprising:

a housing;

a conducting unit installed in the housing and including a first terminal, a second terminal, a first conducting leaf, and a flat bimetal sheet; the bimetal sheet being supported in the housing and having a movable working end, being able to move to an overlord position from a normal position in case of overload, and a fixed opening end formed with first and second legs for respectively connecting with the first terminal and the first conducting leaf; the first conducting leaf being movable between a closed position in which the second leg of the bimetal sheet is electrically connected to the second terminal and a normal-open position in which the second leg is disconnected from the second terminal; and an actuating unit installed in the housing and including:

a stem provided with a heart-shaped stepping recess and slidably moving between an upper reset position and a lower set position;

a locating cantilever provided with a first hand pivotally mounted at the housing and a second hand movably inserted into the heart-shaped stepping recess for locating the position of the stem;

a rocking lever pivotally supported on the stem along a shaft and formed with a nose for depressing the first conducting leaf and with a resting tail opposite to the nose across the shaft;

an enabling rest capable of moving between a supporting position to support the resting tail and a withdrawing position to withdraw from the resting tail, in correspondence with the location of the bimetal sheet in the normal position and the overload position, respectively;

a cantilever pusher for pushing the locating cantilever away from the heart-shaped stepping recess in response to the change of the bimetal sheet into its overload position; and a lever reseating member for pushing the rocking lever into an idle position in which the resting tail could be supported by the enabling rest, during a reset course in which the stem moves from the set position to the reset position;

whereby the nose can depress and release the first conducting leaf so as to make the first conducting leaf move into the closed position and the normal-open position in response to the movement of the stem to its set position and its reset position, respectively, in a situation that the enabling rest locates in its supporting position, and whereby the first conducting leaf and the stem can move to its normal-open position and its reset position, respectively, in response to a change of the bimetal sheet into its overload position.

2. The switch according to claim 1, wherein the working end of the bimetal sheet deflects away from the resting tail upon overload and the working end has a side edge and an end edge, and wherein the enabling rest is integrally formed with the bimetal sheet on the side edge and provided with a platform on which the resting tail can rest.

3. The switch according to claim 2, wherein the locating cantilever moves away from the heart-shaped stepping recess in a direction identical to a direction that the bimetal sheet deflects up on overload, and the cantilever pusher is integrally formed with the bimetal sheet on the end edge and extends toward the locating cantilever such that the cantilever pusher can push the locating cantilever away from the heart-shaped stepping recess in case of overload.

4. The switch according to claim 1, further comprises an enabling lever pivotally mounted on the housing and formed with two free ends, wherein the enabling rest is integrally formed at one of the two free ends and is formed with a platform on which the resting tail can rest, while the other free end of the enabling lever engages with the working end of the bimetal sheet.

5. The switch according to claim 4, wherein the locating cantilever moves away from the heart stepping recess in a direction substantially identical to a direction that the bimetal sheet deflects, and the cantilever pusher is constructed of a crank rod having a hand at each end, one hand thereof being moved along with the enabling lever and the other hand thereof being located between the locating cantilever and the heart-shaped stepping recess such that the locating cantilever is pushed away from the heart-shaped stepping recess when the bimetal sheet is changed to the overload position.

6. The switch according to claim 1, wherein the conducting unit further comprises a third terminal, a lamp having a first and a second pins for connecting with the second and the third terminals respectively, and a second conducting leaf having one end connecting with the third terminal; and wherein the stem further comprises a branch extending therefrom for carrying the first pin of the lamp to connect with the other end of the second conducting leaf.

7. The switch according to claim 6, wherein the actuating unit further comprises a spring for biasing the stem upward and for connecting the second pin of the lamp to the second terminal.

8. The switch according to claim 1, wherein the enabling rest is formed with an up-side platform for supporting the resting tail and an oblique lower surface for permitting the resting tail to slide into the platform.

* * * * *